US006146221A

United States Patent [19]

Natsume

[11] Patent Number: 6,146,221

[45] Date of Patent: Nov. 14, 2000

[54] STEERING LOCK FOR OUTBOARD MOTOR

[75] Inventor: Noriyuki Natsume, Hamamatsu, Japan

[73] Assignee: Sanshin Kogyo Kabushiki Kaisha, Shizuoka-ken, Japan

[21] Appl. No.: 09/164,846

[22] Filed: Oct. 1, 1998

[30] Foreign Application Priority Data

Oct. 1, 1997 [JP] Japan ..... 9-268312

[51] Int. Cl.[7] ..... B63H 5/125

[52] U.S. Cl. ..... 440/55; 440/53; 440/63; 114/144 R; 114/172; 74/531

[58] Field of Search ..... 114/170, 172, 114/144 R; 440/53, 55, 63; 74/531

[56] References Cited

U.S. PATENT DOCUMENTS 2,846,896 8/1958 Allen ..... 114/172
4,018,104 4/1977 Bland et al. ..... 74/531
4,521,201 6/1985 Watanabe .
4,701,141 10/1987 Sumigawa .
5,052,321 10/1991 Toniatti ..... 114/172
5,582,527 12/1996 Nakamura .

*Primary Examiner*—S. Joseph Morano
*Assistant Examiner*—Ajay Vasudeva
*Attorney, Agent, or Firm*—Knobbe, Martens, Olson & Bear LLP

[57] ABSTRACT

An outboard motor has a steering lock which retains the rotational orientation of the outboard motor relative to a watercraft. The steering lock allows the motor to be pivoted about a substantially horizontal tilt and trim axis while the steering lock is engaged. The steering lock includes a friction plate which is advantageously straight. The friction plate is connected to the steering arm, and movement of either the steering arm or the friction plate requires movement of the other. At least one friction lock engages with the friction plate to secure the motor in a desired orientation. The friction lock is rigidly affixed to the outboard motor. The friction lock includes one or more disc pads. Movement of an operation lever urges the disc pads against the friction plate hold the friction plate and consequently, the steering arm, in a predetermined position.

22 Claims, 5 Drawing Sheets

STEERING LOCK FOR OUTBOARD MOTOR

BACKGROUND OF THE INVENTION

1. Field of the Invention

The present invention relates to a steering device for a marine drive, and in particular to a restraining mechanism for the steering device used in conjunction with a marine drive.

2. Description of the Related Art

Many watercraft employ outboard motors that are mounted on the aft end of the watercraft. An outboard motor generally includes a power head that houses an engine, a drive shaft housing situated below the power head, and a lower unit that is positioned below the drive shaft housing. The lower unit typically houses a transmission and a propulsion shaft that drives a propulsion device, such as a propeller.

As is well-known in the art, outboard motors include a clamping bracket which secures the outboard motor to a transom of a watercraft. A swivel bracket is pivotally secured to the clamping bracket so as to allow both steering movement of the motor about a steering axis and trimming and tilting movement of the motor about a tilt and trim axis. The trimming movement relative to the watercraft transom is often required to adjust the angular orientation of a thrust vector associated with a propeller. In particular, by adjusting the trim position of the outboard motor, an optimum orientation of the thrust vector can be obtained.

A tiller or steering arm is attached to the outboard motor to facilitate steering movement. In many instances, it is desirable to mechanically maintain a predetermined tack of the watercraft so that the operator is not required to continually have a hand on the tiller. For example, when the operator is trolling for fish, he or she may want to keep both hands free while the watercraft continues a straight-ahead or circular tack. Similarly, when traveling in a straight line across a current, it is necessary to position the motor to steer slightly into the current to compensate for the forces of the current that tend to turn or propel the watercraft in an undesired direction. Thus, it is desired to have a tiller position-locking device that is capable of maintaining the steering components in any of a continuous array of positions.

Current tiller locks generally incorporate a semi-circular shaped friction plate to track the movement of the tiller. The semi-circular friction plates are rigidly attached to the outboard motor, and project into an inner space in the hull across the entire width of the stern. With friction plates increasing in size, the amount of inner hull space occupied by the tiller locks are also increasing.

What is needed is a steering locking device that is capable of maintaining the desired heading of the watercraft, yet not occupy a large amount of space in the inner hull. Further, the locking device should be easily engaged or disengaged as desired.

SUMMARY OF THE INVENTION

The present invention is a steering lock that occupies only a limited amount of space in the inner hull. An outboard motor is equipped with a friction plate that moves along with the steering arm. By connecting the friction plate to the steering arm, the friction plate can be made substantially straight. The friction plate contains a slot that allows the friction plate to slide along a locking mechanism. Because the friction plate is substantially straight, the amount of inner hull space occupied is minimized. The locking mechanism has at least one friction pad that may be engaged against the friction plate. The friction pad is engaged through the movement of an operation lever. When the friction pad engages the friction plate, the friction plate and therefore the steering arm is held in position.

One embodiment of the present invention is an outboard motor having a clamping bracket adapted to be attached to a watercraft and a swivel bracket pivotally connected to the clamping bracket. The swivel bracket enables a steering movement of the outboard motor relative to the watercraft about a steering axis. A steering arm is attached to the outboard motor to facilitate the steering movement. A steering arm locking device includes a plate connected to the steering arm and a friction lock connected to the swivel bracket. The friction lock is slidably connected to the plate, and movement of the steering arm results in corresponding movement of the plate. The friction lock is capable of securing the plate in a set position, thereby also securing the steering arm in a set position.

The friction lock of the present invention may further comprise a first disc pad positioned on a top side of the plate and a second disc pad positioned on a bottom side of the plate. The friction lock firmly sandwiches the plate between the first and second disc pads to secure the plate in a set position.

The present invention further includes an operation lever having at least a first position and a second position. When the operation lever is in the first position, the plate slides freely and when the operation lever is in the second position the plate is secured in position by the friction lock.

Another embodiment of the present invention is a steering lock assembly for an outboard motor having a friction plate connected to a moveable steering arm, wherein movement of the steering arm results in a corresponding movement by the friction plate. A plate lock is adapted to be fixedly connected to the outboard motor. The plate lock is slidably connected to the friction plate. Also included is an operation lever having at least a first position and a second position. In the first position, the operation lever opens the plate lock to allow the friction plate to slide freely. In the second position, the operation lever closes the plate lock to fix the position of the friction plate.

In one embodiment of the present invention, movement of the operation lever to the second position presses at least one frictional member of the plate lock in contact with a top surface of the friction plate member and presses at least one frictional member of the plate lock in contact with a bottom surface of the friction plate member.

BRIEF DESCRIPTION OF THE DRAWINGS

These and other features of the invention will now be described with reference to the drawings of a preferred embodiment of the present marine propulsion system. The illustrated embodiment of the marine propulsion system is intended to illustrate, but not to limit the in invention. The drawings contain the following figures.

DETAILED DESCRIPTION OF THE PREFERRED EMBODIMENTS OF THE INVENTION

Figure 1:
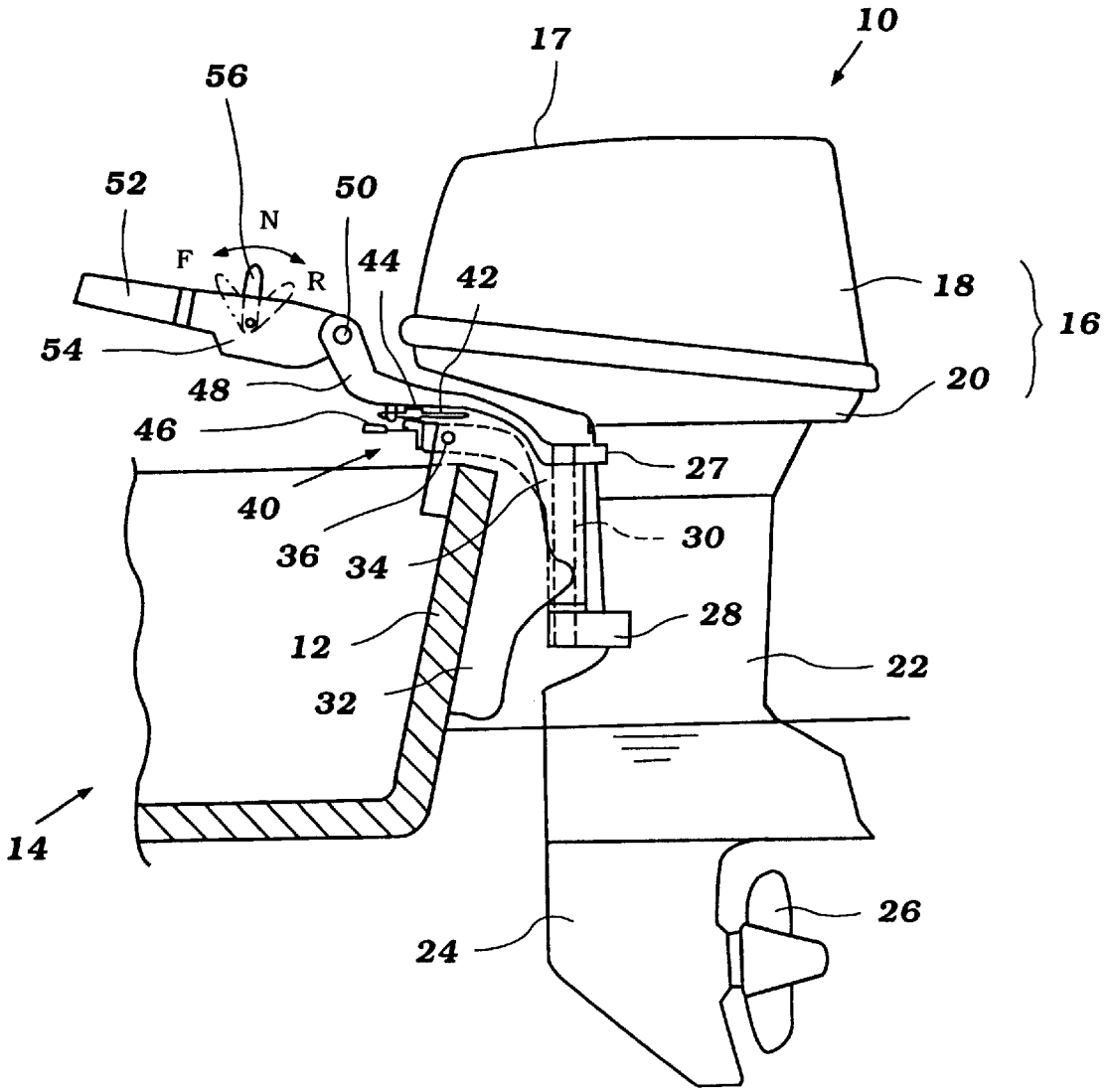
FIG. 1 is a side elevational view of an outboard motor which incorporates a steering lock device according to the present invention.

FIG. 1 illustrates a marine drive configured according to the present invention. In the illustrated embodiment, the marine drive is depicted as an outboard motor 10 for mounting on a transom 12 of the watercraft 14. In the illustrated embodiment, the outboard motor 10 has a power head 16 which desirably includes an internal combustion engine (not shown). The internal combustion engine can have any number of cylinders and cylinder arrangements, and can operate on a variety of known combustion principles (e.g., on a two-stroke or a four-stroke principle).

A protective cowling assembly 17 surrounds the engine. The cowling assembly 17 includes a lower tray 20 and a top cowling 18. The lower tray 20 and the top cowling 18 together define a compartment which houses the engine with the lower tray 20 encircling a lower portion of the engine.

A drive shaft housing 22 extends downwardly from the lower tray 20 and terminates in a lower unit 24. A drive shaft (not shown) extends through the drive shaft housing 22 and is suitably journaled therein for rotation about the vertical axis. The drive shaft housing 22 and lower unit 24 collectively define a casing. A propeller 26 is attached to the rear of the lower unit 24.

A conventional hydraulic tilt-and-trim cylinder assembly (not shown), as well as a conventional steering cylinder assembly, is used with the present outboard motor 10. The construction of the steering and trim mechanisms is considered to be conventional, and for that reason, further description is not believed necessary for an appreciation or understanding of the present invention.

A conventional steering shaft assembly 30 is affixed to the drive shaft housing 22 by upper and lower brackets 27, 28. The brackets 27, 28 support the steering shaft assembly 30 for steering movement. Steering movement occurs about a generally vertical steering axis which extends through a steering shaft of the steering shaft assembly 30. A swivel bracket 34 journals the steering shaft assembly 30 that is attached to the drive shaft housing 22. The swivel bracket 34 is pivotally connected to the clamping bracket 32. The swivel bracket 34 enables a steering movement of the outboard motor 10 relative to the watercraft 14 about the steering axis.

A steering arm 48, which is connected to an upper end of the steering shaft, can extend in a forward direction for manual steering of the outboard motor 10, as known in the art. The steering arm 48 is connected to a lever 54 by a connecting pin 50. Movement of the lever 54 results in a corresponding movement of the steering arm 48. A steering grip 52 is placed at the end of the lever 54 for gripping by the operator.

A shift knob 56 is provided on the lever 54. The shift knob 56 can be moved in at least three positions. In a first position, designated as "F" in FIG. 1, the outboard motor 10 propels the watercraft 14 in a forward direction. In a second position, designated as "N" in FIG. 1, the outboard motor 10 does not propel the watercraft 14. Finally, in a third position, designated as "R" in FIG. 1, the outboard motor 10 propels the watercraft 14 in a reverse direction The steering shaft assembly 30 also is pivotably connected to a clamping bracket 32 by a pin 36. This convention coupling permits the outboard motor 10 to be pivoted relative to the pin 36 to permit adjustment of the trim position of the outboard motor 10 and for tilt-up of the outboard motor 10.

The construction of the outboard motor 10 as thus far described is considered conventional. For this reason, various details of its arrangement and operation have not been given because they are believed to be obvious and well known to those skilled in the art. In accordance with an aspect of the present invention, a steering lock 40 is provided for maintaining the motor 10 in any of the plurality of steering positions which is selected by the operator. The steering lock 40 also allows the outboard motor 10 to be trimmed or tilted about the tilt and trim axis while the steering lock 40 maintains the motor 10 in the selected steering position. As normally employed, the steering lock 40 will maintain the motor 10 in any of a plurality of steering positions such that the associated watercraft 14 is propelled along a predetermined and mechanically maintained tack, such as, a straight line or a predetermined turning radius. The steering lock 40 comprises three main items, a friction plate 42, disc pads 44, and an operation lever 46. The steering lock 40 will be described in further detail in FIGS. 2–5.

Figure 2:
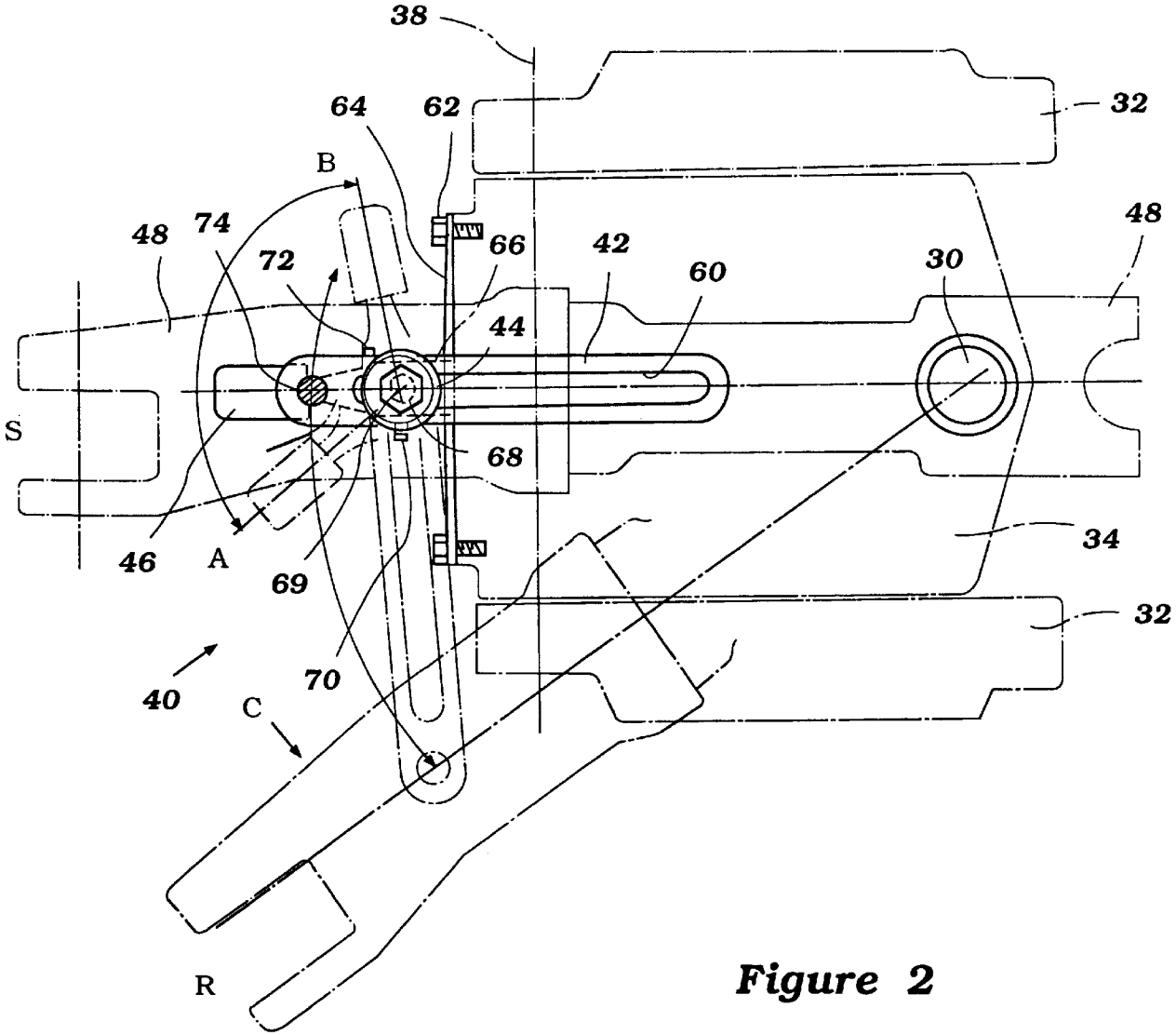
FIG. 2 is a top view of the steering lock device of FIG. 1.
Figure 3:
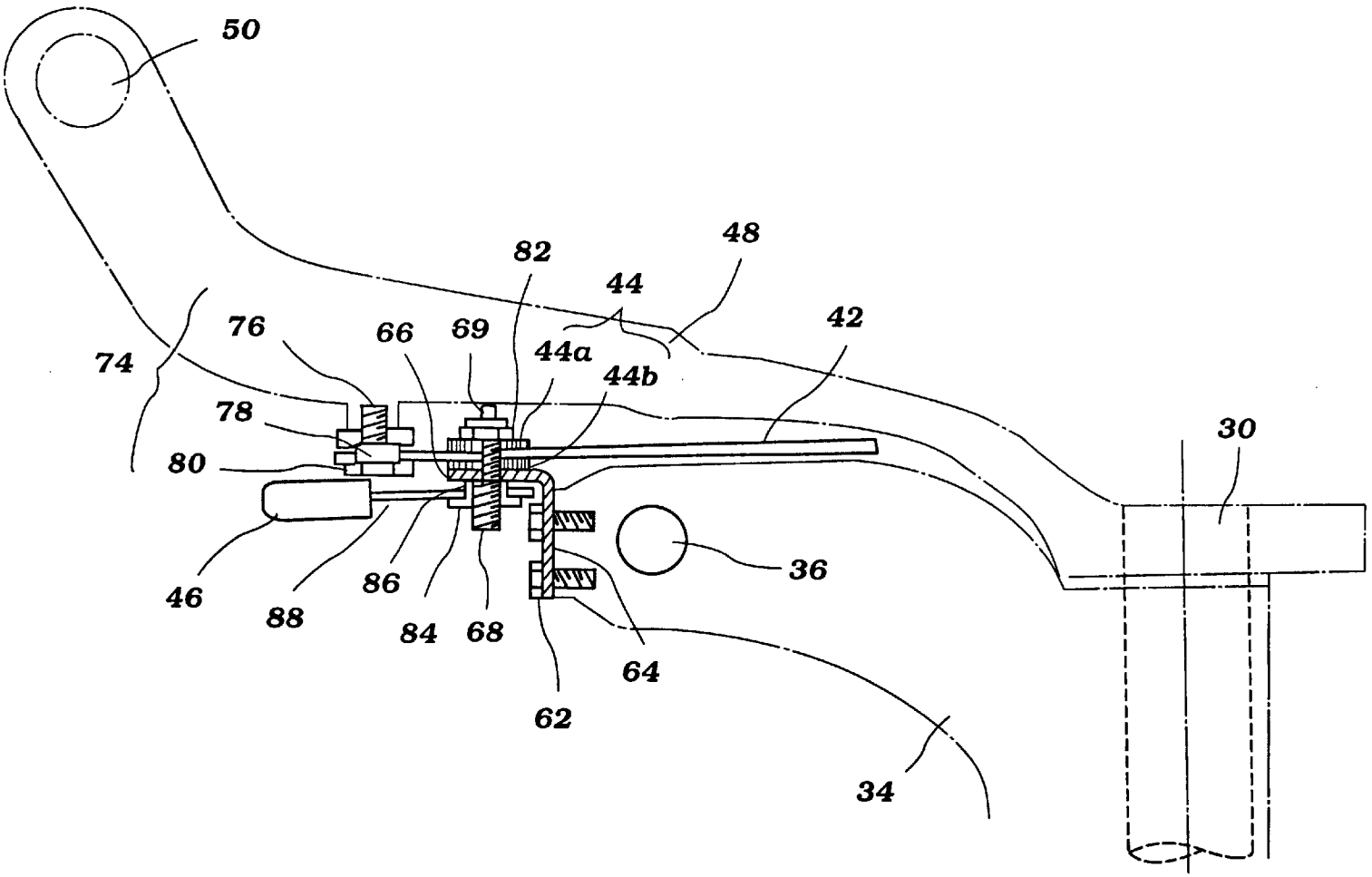
FIG. 3 is a detailed side elevational view of the steering lock device of FIG. 1.
Figure 4:
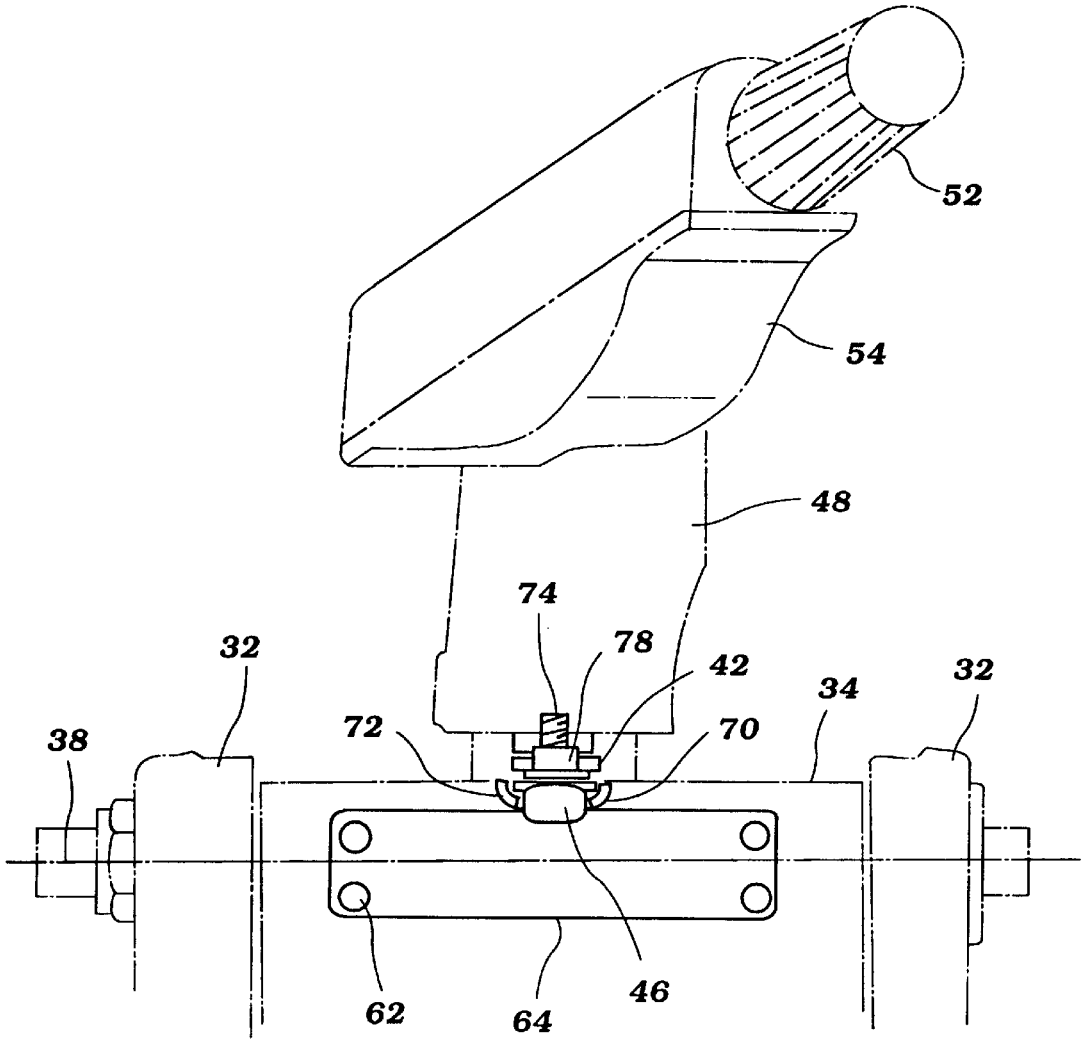
FIG. 4 is a front elevational view of an outboard motor which incorporates the steering lock device according to the present invention.

The steering lock 40 is attached to the outboard motor 10 as shown in FIGS. 2 through 4. A support plate 64 is connected to the swivel bracket 34 by use of bolts 62. Of course, other methods of attaching the support plate to the swivel bracket may be used without departing from the spirit of the invention. Because the support plate is fixed to the swivel bracket 34, any movement of the swivel bracket about the tilt and trim axis 38 will result in corresponding movement by the support plate 64 and therefore the steering lock 40. The support plate 64 is generally angled to form a bottom surface 66 of the steering lock 40.

A stud bolt 68 is inserted through the bottom surface 66 of the support plate to form the core of a friction lock. The stud bolt 68 also extends through a slot 60 in the friction plate 42. The slot 60 extends approximately ¾ of the distance of the friction plate 42, thereby allowing the friction plate 42 to slide along the stud bolt 68. A nut 82 secures the friction plate 42 to the stud bolt 68 from a top side 69 of the stud bolt 68. The opposite side of the stud bolt 68 is secured to the support plate 64 by an operation nut 84.

A pair of disc pads 44*a* and 44*b* are positioned on the stud bolt 68 to sandwich the friction plate 42. If desired, only a single disc pad 44 may be used on either the top surface or the bottom surface of the friction plate 42. The friction plate 42 is generally straight.

The friction plate 42 is secured to the steering arm 48 by a connecting mechanism 74. The connecting mechanism includes a bolt 76 having a head 80, an opening 78 in the friction plate 42, and threads in the steering arm 48. The bolt 76 is inserted through the opening 78. The opening is sized to allow the bolt 76 to pass through and to freely rotate within, but to prevent passage of the head 80 of the bolt 76. After the bolt 76 is inserted through the opening in the friction plate 42, the bolt is secured into the threads of the steering arm 48. Once the friction plate 42 is secured to the steering arm 48, any movement by the steering arm 48 results in a corresponding movement by the friction plate 42. Further, if the friction plate 42 is stationary, the steering arm 48 may not be moved. Because the opening 78 is larger than the bolt 76, movement of the steering arm 48 causes the bolt 76 to rotate within the opening 78. This rotational movement allows the friction plate 42 to easily turn and follow the movement of the steering arm 48.

Movement of the steering arm 48 and the corresponding movement of the friction plate 42 is shown in FIG. 2. When generally straight movement of the watercraft 14 is desired, the steering arm 48 is placed in a position designated as "S" which is generally parallel with the longitudinal axis of the watercraft 14. Maintaining the steering arm in position "S" prevents any rotation by the steering shaft assembly 30, and ensures the watercraft 14 proceeds along a generally straight course (assuming no current). When the steering arm 48 is in position "S", the stud bolt 68 is positioned at one end of the slot 60 in the friction plate. This causes the majority of the friction plate to be positioned to the rear of the stud bolt 68.

To cause the watercraft 14 to turn, the steering arm 48 is moved as indicated by arrow C in FIG. 2. Placing the steering arm 48 in position "R" causes rotation of the steering shaft assembly 30, thereby causing the outboard motor 10 to rotate. This movement applies a sideways thrust to the watercraft 14 resulting in a turn. In position "R", the steering arm 48 is moved from a position directly above the swivel bracket 34 to a position above the clamping bracket 32.

The movement of the steering arm 48 also results in a change in position of the friction plate 42. The portion of the friction plate 42 at the connecting mechanism 74 moves along with the steering arm 48 as indicated by arrow C. As the steering arm 48 moves to position R, the stud bolt 68 slides along the slot 60 of the friction plate 42 until eventually reaching the end of the slot 60. This position is shown in phantom in FIG. 2. In this position, the friction plate 42 is only slightly forward of the support plate 64, thereby minimizing the amount of spaced needed in the inner hull.

The steering lock 40 is engaged by moving the operation lever 46. As shown in FIG. 2, the operation lever 46 may be moved from end stop 70 to end stop 72. In position A, the operation lever 46 is against end stop 70. In position B, the operation lever 46 is against end stop 72. When in position A, the steering lock 40 is disengaged, and the friction plate 42 may freely move along the stud bolt 68. In position B, the steering lock is engaged and the friction plate 42 is secured in position. Placing the operation lever 46 in positions between A and B applies gradually increasing resistance to the friction plate. Details of the operation of the steering lock 40 will be described below.

As stated above, the coupling of the steering shaft assembly 30 and the clamping bracket 32 by the pin 36 permits the outboard motor 10 to be pivoted relative to the pin 36. This permits adjustment of the trim position of the outboard motor 10 and allows for tilt-up of the outboard motor 10. When the steering lock 40 is attached, the support plate 64 lies along the tilt and trim axis 38 as seen in FIG. 4. This causes the steering lock 40 to rotate along the tilt and trim axis 38 when the trim position of the outboard motor is adjusted. Because the entire steering lock 40 is moved along the tilt and trim axis 38, the steering lock is operational in all trim positions.

Figure 5:
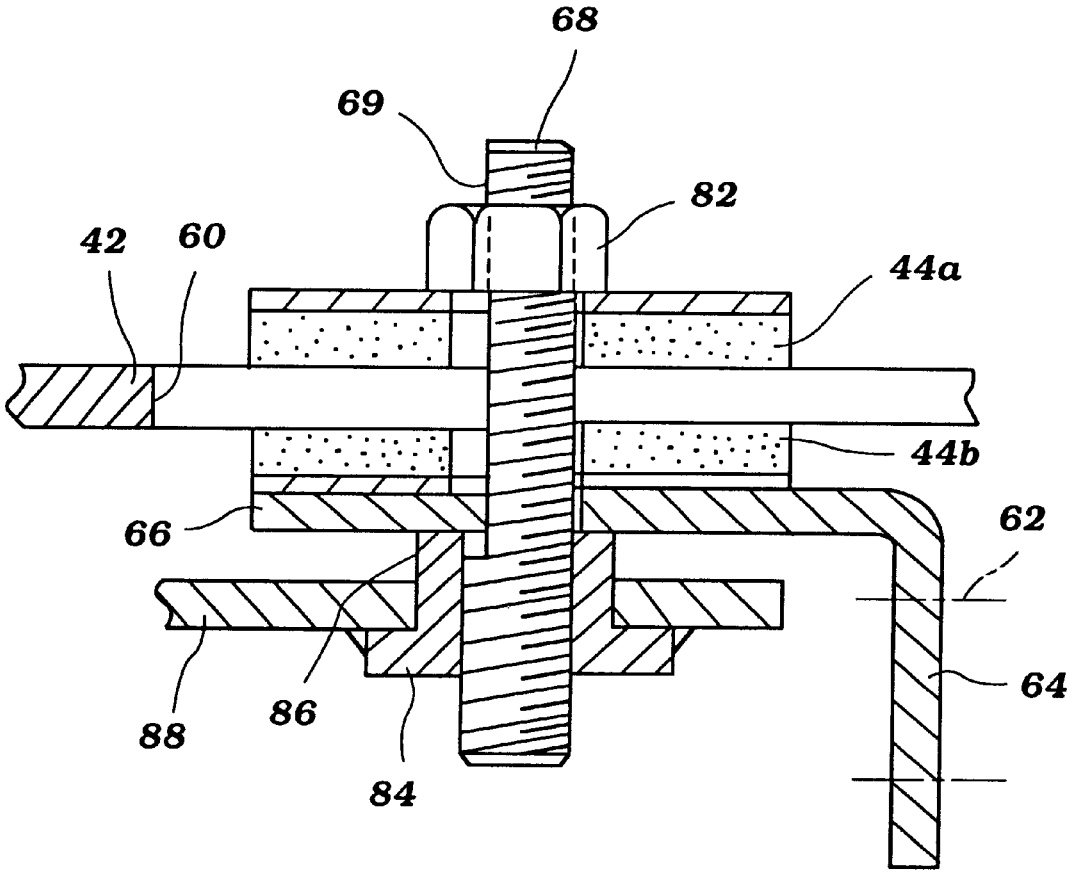
FIG. 5 is a cut-away side view of a portion of the steering lock device according to the present invention.

Operation of the steering lock 40 may be described with reference to FIG. 5. FIG. 5 shows a cut-away view of the steering lock 40 illustrating interaction between each of the steering lock 40 components. The friction plate 42 is shown sandwiched by a first disc pad 44*a* and a second disc pad 44*b*. The stud bolt 68 is inserted through the slot 60 in the friction plate. When pressure is applied to the friction plate 42 from the top and bottom of the disc pad 44*a*, 44*b*, movement of the friction plate is prevented. However, if no pressure is applied to the friction plate 42 by the disc pads 44*a*, 44*b*, the friction plate 42 may freely slide along the stud bolt 68.

Pressure is applied to the top and bottom of the disc pad 44*a*, 44*b* by movement of the operation lever 46. Movement of the operation lever 46 is translated through an arm 88 to rotate the operation nut 84. As the operation nut 84 is rotated upward, the upper surface 86 of the operation nut 84 applies an upward force on the bottom surface 66 of the support plate 64. Because the stud bolt 68 and the support plate 64 are secured in position, this force causes compression of the disc pads 44*a*, 44*b* on the friction plate 42. The compression results in a holding force preventing movement of the friction plate 42. As stated above, when the friction plate 42 is secured in position, the steering arm 48 is also secured in position.

To release this holding force, the operation lever 46 is moved in an opposite direction thereby moving the operation nut 84 lower. This relaxes the compression of the disc pads 44*a*, 44*b* and allows the friction plate 42 to again freely move along the stud bolt 68. This allows the operator to resume manually steering the watercraft 14.

Numerous variations and modifications of the invention will become readily apparent to those skilled in the art. Accordingly, the invention may be embodied in other specific forms without departing from its spirit or essential characteristics. The detailed embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. An outboard motor comprising a clamping bracket adapted to be attached to a watercraft, a swivel bracket pivotally connected to the clamping bracket, the swivel bracket enabling a steering movement of the outboard motor relative to the watercraft about a steering axis, a steering arm attached to the outboard motor to facilitate the steering movement, a steering arm locking device having a plate connected to the steering arm and a friction lock connected to the swivel bracket, the friction lock being slidably connected to the plate, wherein steering movement of the steering arm results in corresponding movement of the plate, the friction lock being capable of securing the plate in a set position, thereby securing the steering arm in a set position.

2. The outboard motor of claim 1, wherein the plate is substantially straight.

3. The outboard motor of claim 1, wherein the friction lock connects to the plate through a slot formed in the plate.

4. The outboard motor of claim 1, wherein the friction lock comprises at least one disc pad for securing the plate in position.

5. The outboard motor of claim 4, wherein a first disc pad is positioned on a top side of the plate, and a second disc pad is positioned on a bottom side of the plate, wherein the friction lock firmly sandwiches the plate between the first and second disc pads to secure the plate in the set position.

6. The outboard motor of claim 1, wherein the friction lock further comprises an operation lever having at least a first position and a second position, wherein when the operation lever is in the first position the plate slides freely and when the operation lever is in the second position the plate is secured in position by the friction lock.

7. A steering lock assembly for an outboard motor comprising a friction plate connected to a moveable steering arm, wherein a steering movement of the steering arm results in a corresponding movement by the friction plate, a plate lock affixed to a mounting bracket of the outboard motor, the plate lock being slidably connected to the friction plate, and an operation lever having at least a first position and a second position, wherein in the first position the operation lever opens the plate lock to allow the friction plate to slide freely, and in the second position the operation lever closes the plate lock to fix the position of the friction plate.

8. The steering lock assembly of claim 7, wherein the friction plate is straight.

9. The steering lock assembly of claim 7, wherein movement of the steering arm requires movement of the friction plate.

10. The steering lock assembly of claim 7, wherein the plate lock connects to the friction plate through a slot formed in the friction plate.

11. The steering lock assembly of claim 7, wherein the plate lock is adapted to be fixedly connected to a swivel bracket of the outboard motor.

12. The steering lock assembly of claim 7, wherein movement of the operation lever to the second position presses at least one frictional member of the plate lock in contact with the friction plate.

13. The steering lock assembly of claim 12, wherein movement of the operation lever to the second position presses at least one frictional member of the plate lock in contact with a top surface of the friction plate member and presses at least one frictional member of the plate lock in contact with a bottom surface of the friction plate member.

14. An outboard motor comprising a drive unit carrying a propulsion device, a clamping bracket adapted to be attached to a watercraft, a swivel bracket pivotally connected to the clamping bracket, the swivel bracket enabling a steering movement of the drive unit relative to the watercraft about a steering axis, a steering arm attached to the drive unit to facilitate the steering movement, a steering arm locking device having a plate pivotally connected to the steering arm and a friction lock connected to the swivel bracket, wherein the steering movement of the steering arm results in a pivotal movement of the plate relative to the steering arm, the friction lock being capable of securing the plate in a set position.

15. The outboard motor of claim 14, wherein the friction lock is slidably connected to the plate, and the steering movement of the steering arm additionally results in a slide movement of the plate relative to the friction lock.

16. A steering lock device for a drive assembly of an outboard motor comprising a friction plate pivotally connected to a moveable steering arm, wherein a movement of the steering arm results in a pivotal movement by the friction plate relative to the steering arm, a plate lock affixed to the drive assembly, and an operation lever having at least a first position and a second position, wherein in the first position the operation lever opens the plate lock to allow the friction plate to pivot freely, and in the second position the operation lever closes the plate lock to fix the position of the friction plate.

17. The steering lock device of claim 16, wherein the plate lock is slidably connected to the friction plate, and the movement of the steering arm additionally results in a slide movement by the friction plate relative to the plate lock.

18. A steering lock mechanism for an outboard motor having a drive unit carrying a propulsion device, a swivel bracket pivotally supporting the drive unit and a steering arm coupled to the drive unit for a pivotal movement of the drive unit relative to the swivel bracket, the lock mechanism comprising a slender member pivotally coupled to the steering arm, the slender member having a slot extending along a longitudinal axis of the member, a lock unit affixed to the swivel bracket, the lock unit being slidably fitted in the slot, whereby the slender member pivots relative to the steering arm and slides relative to the lock unit when the steering arm is pivoted relative to the swivel bracket, and the lock unit being capable of locking the slender member in a set position wherein the steering arm is substantially unmovable relative to the swivel bracket.

19. The steering lock mechanism of claim 18, wherein the slender member is a plate.

20. The steering lock mechanism of claim 18, wherein the slender member is substantially straight.

21. The steering lock mechanism of claim 18, wherein the lock unit comprises at least one friction member for locking the slender member in the set position.

22. The steering lock mechanism of claim 21, wherein a first friction member is positioned on a top side of the slender member, and a second friction member is positioned on a bottom side of the slender member, wherein the lock unit securely interposes the slender member between the first and second friction members to lock the slender member in the set position.

* * * * *